United States Patent [19]

Bailey

[11] Patent Number: 4,941,560

[45] Date of Patent: Jul. 17, 1990

[54] SECURITY DEVICE FOR TROLLEYS

[75] Inventor: Raymond J. Bailey, Caboolture, Australia

[73] Assignee: GDT PTY. Ltd., Queensland, Australia

[21] Appl. No.: 328,127

[22] PCT Filed: Apr. 6, 1988

[86] PCT No.: PCT/AU87/00240

§ 371 Date: Feb. 3, 1989

§ 102(e) Date: Feb. 3, 1989

[87] PCT Pub. No.: WO88/01084

PCT Pub. Date: Feb. 11, 1988

[30] Foreign Application Priority Data

Aug. 6, 1986 [AU] Australia ..... PH7304

[51] Int. Cl.[5] ..... G07F 17/00

[52] U.S. Cl. ..... 194/250; 194/298; 194/905

[58] Field of Search ..... 194/205, 249, 250, 253, 194/259, 294, 298, 343, 905; 280/33.991, 33.992, 33.994, DIG. 4

[56] References Cited

U.S. PATENT DOCUMENTS 2,753,970 7/1956 Breeler .
4,474,280 10/1984 Lenander .
4,635,782 1/1987 Wieth et al. ..... 194/905 X
4,691,816 9/1987 Trubiano ..... 194/905 X
4,766,989 8/1988 Maloeuvre et al. ..... 194/905 X

FOREIGN PATENT DOCUMENTS 0125127 11/1984 European Pat. Off. .
0199274 10/1986 European Pat. Off. .
2593949 8/1987 France ..... 280/33.992
PCT/FR85/-00374 4/1985 PCT Int'l Appl. .
84/04835 12/1984 World Int. Prop. O. ..... 194/905

*Primary Examiner*—Joseph J. Rolla
*Attorney, Agent, or Firm*—Larson and Taylor

[57] ABSTRACT

A security device (10) to releasably secure articles in a queue, row or stack has a body (11, 12) to be clamped on one of the articles by a loop section (14) and lugs (17). A key (26) attached by a chain or cable to a second device (10) is received in a slot (30, 31) in the body and is releasably engaged by a peg (39) on a pivotally mounted operating arm (34), in a cavity (29) of the body entering a slot (27) in the key (26). The key (26) can only be released when a coin or token is received in a coin holder (47) in a pusher unit (48) which advances a tongue (40), the nose (41) of which engages a cam face (42) on the operating arm (34) to move the latter to release the key (26). The pusher unit (48) can only be moved to recover the coin or token from the coin holder (47) when the key (26) has been reinserted in the body and engaged by the operating arm (34).

15 Claims, 3 Drawing Sheets

SECURITY DEVICE FOR TROLLEYS

BACKGROUND OF THE INVENTION (1) Field of the Invention

THIS INVENTION relates to a security device for trolleys or other equipment stored in queues, rows or stacks. The invention is particularly suitable for, but not limited to, a security device for supermarket trolleys.

(2) Prior Art

Large supermarkets may provide several hundred shopping trolleys for the convenience of their customers. The collection of the shopping trolleys from the surrounding car parks is very labour intensive, as there is little incentive for shoppers to return the trolleys to designated collection points.

A system has been developed in West Germany where the shopping trolleys are releasably connected together in queues and stacks within the supermarket. The customer inserts a coin into a unit which connects adjacent trolleys in each queue or stack to release the first available trolley. On returning the trolley to the trolley queue or stack, and connecting it to the queue or stack, the unit returns the coin. While this system has reduced labour costs for the collection of the trolleys, it has been found that the units can easily be tampered with, fail to release the coins, and are prone to frequent failure due to internal wear and damage.

SUMMARY OF THE PRESENT INVENTION

It is an object of the present invention to provide a single, yet effective, device for releasably securing supermarket trolleys or other hire equipment together.

It is a preferred object, to provide a device which is robust, simple to operate, and generally vandal proof.

Other preferred objects of the present invention will become apparent from the following description.

In a broad aspect the present invention resides in a security device for releasably connecting an article to at least one other article in a queue, row or stack of the articles, the device including:

a body mountable on the article;

a flexable member attached to one end of the body and having a key means at its free end;

a longitudinal cavity in the other end of the body to releasably receive the key means of a similar device on a second article in the queue, row or stack;

a locking arm in the cavity to releasably engage the key of the device on the second article;

a tongue in the body operable to move the locking arm between respective released and engaged positions with the key of the device on the second article; and an operating member movably mounted in the body arranged to receive a coin or token and so arranged that the operating member will move the tongue only when a coin or token is received in the operating member.

The body may be die cast or moulded of plastic and may be arranged to be clamped or otherwise fixed to the article e.g. on a handle thereof.

Preferably the flexible member is a chain or cable.

Preferably the tongue is slidably mounted in the cavity in the body.

Preferably the locking arm is hingedly or pivotally mounted in the cavity and has a first cam face engageable by the tongue to move the locking arm to its released position to enable the key to be withdrawn from the body, and a second cam face engageable by the key to enable the key to be inserted into the body.

Preferably the locking arm includes a recess or abutment to releasably engage the tongue when the key has been withdrawn, to prevent access to the coin.

Preferably the locking arm includes a peg or pin releasably engageable in a slot or recess in the key when the locking arm is in its engaged position Preferably a spring is provided in the body to urge the locking arm to its engaged position.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENTS

The device 10 has a two piece body formed of die cast material, the upper and lower body parts 11, 12 being located together by spigots 13 and recesses 14 and secured together by screw fasteners (not shown).

Figure 1:
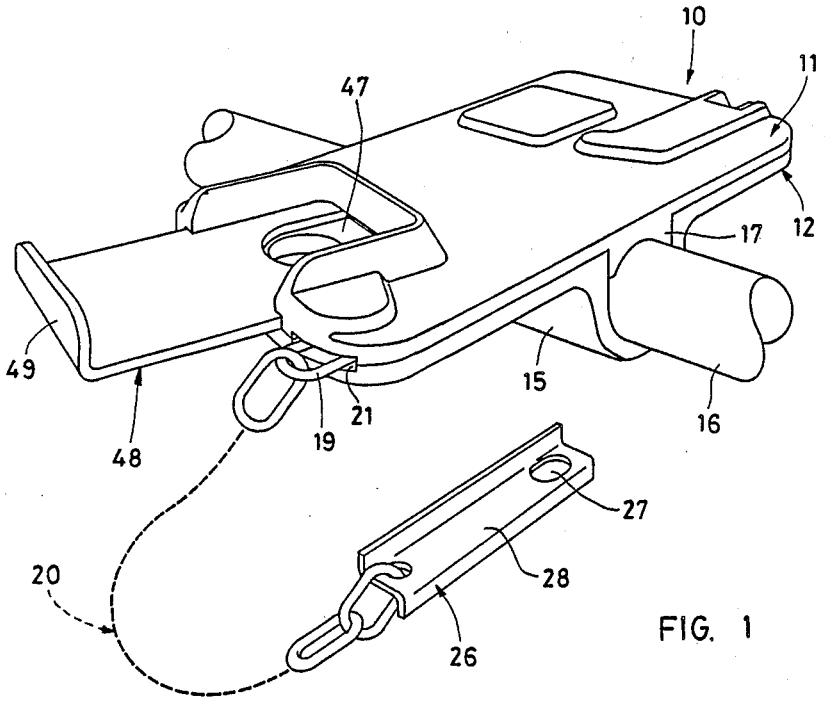
FIG. 1 is a prespective view of the device fitted to the handle of a supermarket trolley.
Figure 2:
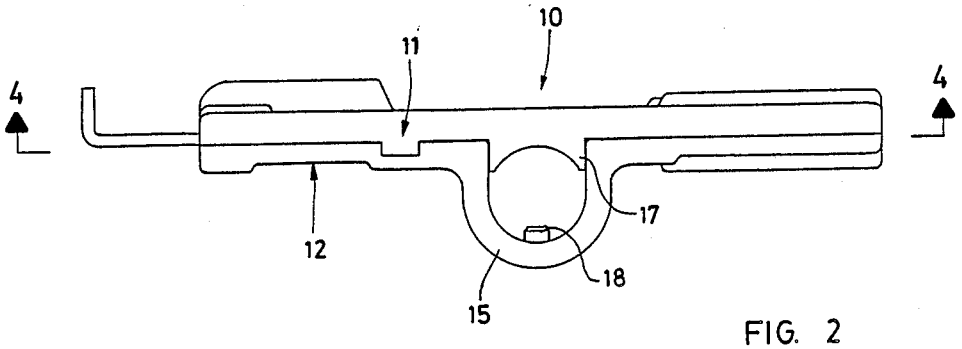
FIG. 2 is a side view of the device.
Figure 3:
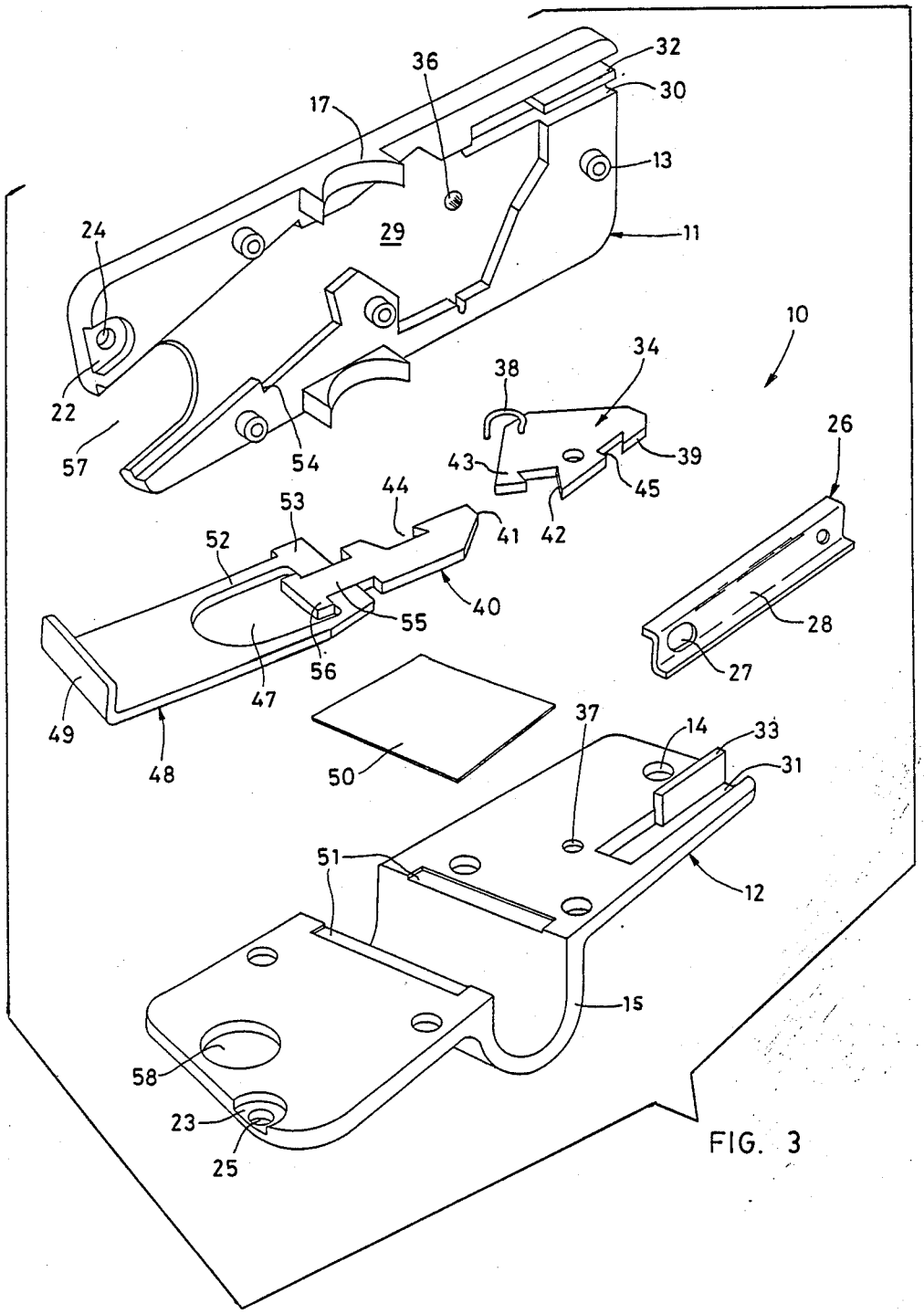
FIG. 3 is an exploded perspective view of the components of the device.

As shown in FIGS. 1 to 3, a loop section 15 in the lower body part 12 receives the handle 16 of a supermarket trolley (not shown), the handle being clamped by lugs 17 on the upper body part 11. A pin 18 in the loop section 15 engages a complementary hole (not shown) in the handle 16 to locate the device 10 on the handle.

A loop 19 of a chain 20 is received in a slot 21 formed by recesses 22, 23 at one end of the body parts 11, 12 and is secured by a screw fastener (not shown) received in holes 24, 25 in the body parts. A Z-section key 26 is attached to the other end of the chain 20 and has an elongate slot 27 adjacent one end of its central web 28.

An elongate cavity 29 is formed in the upper body part 11 and has an end section 30 aligned with a complementary cavity section 31 in the lower body part 11. Guide lugs 32, 33, associated with the cavity section 30, 31, forms a Z-shaped slot in the end of the body 10 to receive the key 26 of a second device.

Figure 4:
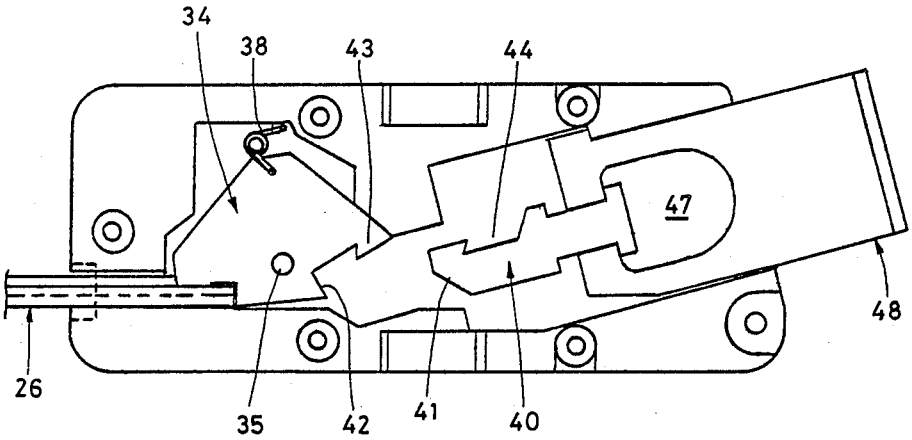
FIGS. 4 and 5 are sectional views of the device, taken on line 4–4 on FIG. 2, showing the device in its locked and released positions respectively.

The key 26 is releasably engaged by a locking arm 34 pivotally mounted on a pin 35 received in recesses 36, 37 in the body parts. A spring 38 urges the locking arm 34 to its engaged position shown in FIG. 4, where a peg 39 engages the slot 27 in the key 26.

The locking arm 34 is operated by a tongue 40 slidably mounted in the cavity 29. The tongue 40 has a nose 41 which engages a first cam face 42 on the locking arm to urge the latter to release the key as the tongue is advanced (see FIGS. 4 and 5).

In the released position (see FIG. 5), a finger 43 on the locking arm 34 engages a recess 44 in the side of the tongue to prevent the latter from being retracted. When the key 26 is reinserted into the body, it engages a second cam face 45 on the locking arm and moves the latter to the engaged position in FIG. 4, releasing the tongue 40.

The tongue 40 can only be advanced to cause the operating arm 34 to release the key 26 when a coin or token 46 is received in a holder 47 in a pusher unit 48 (axially aligned with the tongue) which extends from the body 11 and has a handle 49. (The tongue 40, pusher unit 48 and the coin or token 46 are supported by a plate 50 engaged in recess 51 in the lower body part 12, the plate being received between the lugs 17).

A pair of arms 52 extend forwardly of the pusher unit 48 and have transverse flanges 53 at the inner ends. The outer end of one of the flanges 53 engages an abutment face 54 in the cavity 29 to prevent the pusher unit from being withdrawn from the body 10. The inner ends receive a guide or shaft 55 and head 56 onthe tongue 40 to provide a lost-motion connection between the tongue and pusher unit when no coin or token is provided in the holder 47.

The coin or token 46 is inserted into the coin holder 47 via a coin feed recess 57 in the upper body part 11. To prevent undersize coins or tokens being used, a hole 58 in the lower body part 12 allows these coins to fall out of the coin holder while oversize coins or tokens will not fit into the holder and enter the body.

In use, the key 26 of the next trolley in the queue is engaged in the device (see FIG. 4) and the pusher unit is in the position shown in FIGS. 1 to 4. The user places a coin or token 46 in the coin holder 47 and pushes the pusher unit 48 into the body. The coin or token advances the tongue 40 and it causes the operating arm 34 to pivot (see FIG. 5) to release the peg 39 from the slot 27 in the key 26. The trolley can be withdrawn from the queue.

On the return, the trolley is returned to the queue and the key 26 of the end trolley is inserted into the body. The key 26 engages the second cam face 45 and pivotally moves the operating arm to cause the peg 39 to engage the key. The trolley is now secured to the queue. The operating arm 34 pushes the tongue 40 to extend the pusher unit (see FIG. 4) so that the coin or token 46 can be returned. (The coin or token is lifted out of the coin holder 47 by pushing a finger up through the hole 58.)

Figure 5:
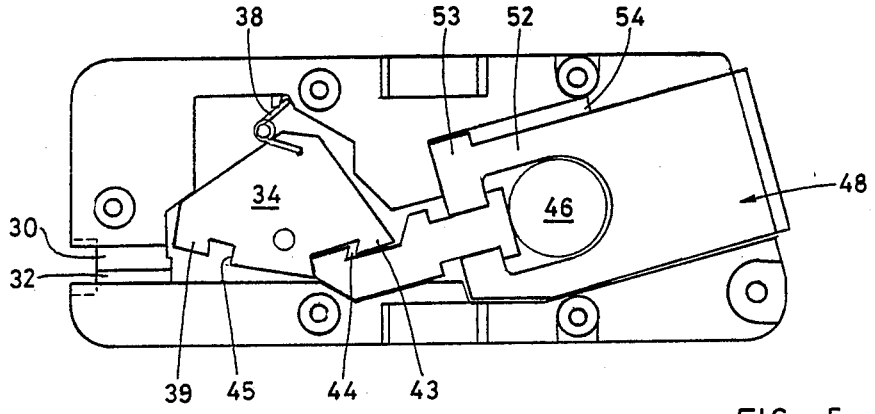

If a person tries to recover the coin or token without securing the trolley to the queue, the tongue 40 is locked in the position shown in FIG. 5 by the finger 43 on the operating arm and so the pusher unit cannot be pulled to exposed the coin or token in the coin feed recess 57.

If a person tries to release the trolley without inserting a coin or token in the coin holder 47, the lost-motion connection between the pusher unit and the tongue will allow the former to be pushed into the body without advancing the tongue to move the operating arm.

In a modified form of the present embodiment the device 10 may be mounted on the frame of the trolley e.g. on one side. For other articles, the device may be mounted on, or cast or moulded integrally in the article itself. The key 26 may be designed with a range of cross-sections e.g. channel or U-section, L-section, or planar or the locking arm 36 may engage slot(s) or recesses in at least one side of the key.

It will be readily apparent to the skilled addressee that various other changes and modifications can be made to the embodiment shown, by way of illustrative example only, without departing from the present invention defined in the appended claims, and that the device can be used in a wide range of applications where the release of articles from a queue, row or stack must be controlled and their return encouraged.

I claim:

1. A security device for releasably connecting an article to at least one other article in a queue, row or stack of the articles, the device including:

a body mountable on the article and having two ends;

a flexible member attached to one said end of the body and having a key means at a free end of said flexible member;

a longitudinal cavity in the other said end of the body to releasably receive the key means of a similar device on a second article in the queue, row or stack;

a locking arm movably mounted in the cavity to releasably engage the key means of the device on the second article;

a tongue in the body operable to move the locking arm from an engaged position with the key means of the device on the second article to a released position where the key means is no longer engaged by the locking arm; and an operating member movably mounted in the body and arranged to receive a suitable coin and so arranged that the operating member will move the tongue only when the coin is received in the operating member;

wherein the locking arm has (a) a first cam face engageable by the tongue to move the locking arm to the released position to enable the key means to be withdrawn from the body, (b) a second cam face engageable by the key means as the key means is inserted into the body to move the locking arm to the engaged position where the locking arm engages the key means and (c) and engaging means for releasably engaging the tongue when the key means is released such that retrieval of the coin from the operating member is prevented.

2. A security device according to claim 1 wherein:

the tongue is slidably mounted in the cavity in the body;

the operating member is a pusher unit axially aligned with the tongue and is slidably mounted in the cavity in the body; and the tongue and pusher unit are interconnected by a lost-motion connection which allows the tongue and pusher unit to move relative to each other when the coin is not received in the pusher unit.

3. A security device according to claim 2 wherein:

a coin feed recess is provided in the body to enable the coin to be received in a coin holder in the pusher unit only when the pusher unit is in an extended position and the key means is engaged by the locking arm.

4. A security device as claimed in claim 1 wherein:

the locking arm includes a projection releasably engageable in a corresponding receiver in the key means when the locking arm is in the engaged position.

5. A security device as claimed in claim 1 wherein:

the body incorporates integral clamp means to secure the body to the article; and the flexible member secures the key means to the body adjacent the operating member.

6. A security device as claimed in claim 1 wherein:

spring means are provided in the cavity to urge the locking arm to its engaged position.

7. A security device as claimed in claim 1 wherein:

the key means is of substantially Z cross-section and is received in a correspondingly configured section of the cavity in the body.

8. A security device as claimed in claim 1 wherein:

the body is formed of two separable body parts aligned by spigot-recess assemblies, and the cavity is formed in one of the body parts.

9. A security device for releasably connecting an article to at least one other article in a queue, row or stack of the articles, the device including:

a body mountable on the article and having two ends;

a flexible member attached to one said end of the body and having a key means at a face end of said flexible member;

a longitudinal cavity in the other said end of the body to releasably receive the key means of a similar device on a second article in the queue, row or stack;

a locking arm movably mounted in the cavity to releasably engage the key means of the device on the second article;

a tongue in the body operable to move the locking arm from an engaged position with the key means of the device on the second article to a released position where the key means is no longer engaged by the locking arm; and an operating member movably mounted in the body and arranged to receive a suitable coin and so arranged that the operating member will move the tongue only when the coin is received in the operating member;

wherein the locking arm has (a) a first cam face engagable by the tongue to move the locking arm to the released position to enable the key means to be withdrawn from the body, and (b) a second cam face engageable by the key means as the key means is inserted into the body to move the locking arm to the engaged position where the locking arm engages the key means; and wherein the key means is of substantially Z cross-section and is received in a correspondingly configured section of the cavity in the body.

10. a security device according to claim 9 wherein:

the tongue is slidably mounted in the cavity in the body;

the operating member is a pusher unit axially aligned with the tongue and is slidably mounted in the cavity in the body; and the tongue and pusher unit are interconnected by a lost-motion connection which allows the tongue and pusher unit to move relative to each other when the coin is not received in the pusher unit.

11. A security device according to claim 9 wherein:

a coin feed recess is provided in the body to enable the coin to be received in a coin holder in the pusher unit only when the pusher unit is in an extended position and the key means is engaged by the locking arm.

12. A security device as claimed in claim 9 wherein:

the locking arm includes a projection releasably engageable in a corresponding receiver in the key means when the locking arm is in the engaged position.

13. A security device as claimed in claim 9 wherein:

the body incorporates integral clamp means to secure the body to the article; and the flexible member secures the key means to the body adjacent the operating member.

14. A security device as claimed in claim 9 wherein:

spring means are provided in the cavity to urge the locking arm to its engaged position.

15. A security device as claimed in claim 9 wherein:

the body is formed of two separable body parts aligned by spigot-recess assemblies, and the cavity is formed in one of the body parts.

* * * * *